US006913801B2

(12) United States Patent
Kim et al.

(10) Patent No.: US 6,913,801 B2
(45) Date of Patent: Jul. 5, 2005

(54) PRINTING MEDIA FOR INKJET PRINTER

(75) Inventors: Jae-hwan Kim, Gyeonggi-do (KR); Taekkyong Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 15 days.

(21) Appl. No.: 10/449,768

(22) Filed: Jun. 2, 2003

(65) Prior Publication Data

US 2003/0228428 A1 Dec. 11, 2003

(30) Foreign Application Priority Data

Jun. 8, 2002 (KR) ..... 10-2002-0032180

(51) Int. Cl.[7] ..... B41M 5/40

(52) U.S. Cl. ..... 428/32.25; 428/32.26; 428/32.27; 428/32.28; 428/32.29; 428/32.38

(58) Field of Search ..... 428/32.25, 32.26, 428/32.27, 32.28, 32.29, 32.38

(56) References Cited

U.S. PATENT DOCUMENTS 5,576,088 A 11/1996 Ogawa et al. ..... 428/327
5,958,564 A 9/1999 Iwamoto et al. ..... 428/212
6,387,473 B1 * 5/2002 Sismondi et al. ..... 428/32.34

FOREIGN PATENT DOCUMENTS

KR 181414 4/1999

* cited by examiner

*Primary Examiner*—B. Shewareged
(74) *Attorney, Agent, or Firm*—Staas & Halsey LLP

(57) ABSTRACT

A recording medium for an inkjet printer includes a substrate and an ink receiving layer formed thereon and has an ink absorbing layer having a pigment and a binder, and an ink fixation layer having the pigment, the binder and polyether siloxane copolymer. The recording medium has good coating surface properties by improving surface wetting, a leveling property and flowability by adding the polyether siloxane copolymer to the ink fixation layer during coating, as a component enhancing physical properties of the ink fixation layer.

23 Claims, 1 Drawing Sheet

PRINTING MEDIA FOR INKJET PRINTER

CROSS-REFERENCE TO RELATED APPLICATIONS

This application claims the benefit of Korean Application No. 2002-32180, filed Jun. 8, 2002, in the Korean Intellectual Property Office, the disclosure of which is incorporated herein by reference.

BACKGROUND OF THE INVENTION

1. Field of the Invention

The present invention relates to recording media for an inkjet printer, and more particularly, to recording media for an inkjet printer having multi-layered coatings of two or more ink receiving layers comprising at least a pigment and a binder on a substrate.

2. Description of the Related Art

Inkjet printing has gained wide acceptance by consumers in the printing industry because it is fast in printing speed and is a relatively inexpensive form of printing and yet it produces high resolution printed images.

In inkjet printers, various kinds of recording media including ordinary paper, specially coated paper or printing dedicated films, are used, and photopaper for use in an inkjet printer is one of the recording media.

The photopaper for inkjet printers is prepared by coating materials having good ink absorption and fixation properties and good water and light resistance on a substrate, such as one side coated or double side coated art paper, cast-coated paper, resin-coated paper, synthetic paper or a plastic film, and is used in digital photography or image printing using thermal, piezo or phase change inkjet printers. The photopaper for the inkjet printers is also applied to decorating or designing of outer walls, advertising and so on.

Along with development of the inkjet printers based on inkjet recording methods, a variety of inkjet recording media are being developed for commercialization.

For example, U.S. Pat. No. 5,958,564 describes an inkjet recording sheet having two ink receiving layers on a paper support member exhibiting a good ink absorption property. However, since particle sizes of silica used in a second ink receiving layer are larger than those of silica used in a first ink receiving layer, that is, at least 7 $\mu$m, it is quite difficult to obtain a highly glossy surface just by using the two ink receiving layers.

U.S. Pat. No. 5,576,088 discloses an inkjet recording sheet having an ink receiving layer coated on a support and a gloss-providing layer formed on the ink receiving layer. In this disclosure, the support is prevalently paper. Thus, it is difficult to apply the disclosed inkjet recording sheet to films.

Inkjet paper is largely classified into resin paper having a binder as a main component, and porous paper having a microporous pigment as a main component. Inkjet photopaper is typically the porous paper exhibiting a quick ink drying property and good water resistance. In order to obtain excellent ink absorption, it is necessary for an ink receiving layer to have a thickness of at least 30 $\mu$m. In some cases, coating of ink receiving layers for the porous paper, which are much thicker than those for the resin paper, may be employed, which is quite unfavorable in view of processability and coating surface properties. A multi-layered ink receiving layer, including an ink absorbing layer, an ink fixation layer, an ink permeation layer and/or an ink protecting (gloss-providing) layer, generally has better properties than a single-layered ink receiving layer. However, the multi-layered ink receiving layer is difficult to attain. In some other cases, a coating layer having a microporous pigment as one of main components may be coated on another coating layer having another microporous pigment as one of main components. In such cases, if a film based support member with a poor absorbing property is used, pinholes, cratering, orange-peeling or foams may be generated, thereby deteriorating coating surface properties.

SUMMARY OF THE INVENTION

To solve the above and/or other problems, the present invention provides a recording medium for an inkjet printer having multiple coatings of two or more ink receiving layers including at least a pigment and a binder resin on a substrate, thereby providing good coating surface properties by improving substrate wetting, a leveling property and flowability.

Additional aspects and advantages of the invention will be set forth in part in the description which follows and, in part, will be obvious from the description, or may be learned by practice of the invention.

In an aspect of the present invention, there is provided a recording medium for an inkjet printer including a substrate and an ink receiving layer formed thereon, wherein the ink receiving layer includes an ink absorbing layer having a pigment and a binder, and an ink fixation layer having a pigment, a binder and a polyether siloxane copolymer.

A weight-average molecular weight of the polyether siloxane copolymer is in a range of 100 to 10,000, and an amount of the polyether siloxane copolymer is in a range of 0.01 to 3 parts by weight per 100 parts by weight of solid matter in the ink fixation layer.

The polyether siloxane copolymer may be at least one selected from a group consisting of dimethylsiloxane-methyl (polyoxyethylene) copolymer, dimethylsiloxane-methyl (polyoxyethylene-polyoxypropylene) siloxane copolymer, trisiloxane alkoxylate as a copolymer of trisiloxane and polyether, and siloxane propoxylate as a copolymer of siloxane and polypropylene oxide.

The pigment may be at least one selected from a group consisting of silica, alumina, calcium carbonate, magnesium carbonate, barium sulfate, calcium sulfate and titanium dioxide. The pigment may be in a form of powder or sol. Also, an amount of the pigment in the ink absorbing layer is from 50 to 95 parts by weight per 100 parts by weight of the solid matter in the ink absorbing layer, and an amount of the pigment in the ink fixation layer is from 50 to 95 parts by weight per 100 parts by weight of solid matter in the ink fixation layer.

The binder may be at least one selected from a group consisting of polyvinylalcohol, polyvinylpyrrolidone, methyl cellulose, hydroxypropylmethyl cellulose, gelatin, polyethylene oxide, acryl-based polymer, polyester, polyester and quaternary ammonium type copolymer. An amount of the binder in the ink absorbing layer is from 5 to 50 parts by weight per 100 parts by weight of the solid matter in the ink absorbing layer, and an amount of the binder in the ink fixation layer is from 5 to 50 parts by weight per 100 parts by weight of the solid matter in the ink fixation layer.

Each of the ink absorbing layer and the ink fixation layer may further include an additive, and the additive is at least one selected from a group consisting of a cross-linking agent, a fixing agent, a dye, a fluorescent dye, a dispersing agent, a pH adjusting agent, an antioxidant, an antifoaming or defoaming agent, a lubricating agent and an anticurling agent. An amount of the additive in the ink absorbing layer is from 0.015 to 10 parts by weight per 100 parts by weight of the binder and the pigment in the ink absorbing layer, and the amount of the additive in the ink fixation layer is from 0.015 to 10 parts by weight per 100 parts by weight of the binder and the pigment in the ink fixation layer.

The cross-linking agent may be at least one selected from a group consisting of oxazoline, isocyanate, epoxide, aziridine, mellamin-formaldehyde, dialdehyde and a boron compound.

The substrate may be synthetic paper (polypropylene), resin-coated paper, a polyester film, a polycarbonate film or a cellulose acetate film.

The recording medium may further include an undercoating formed between the substrate and the ink receiving layer.

Also, the recording medium may further include a back coating formed on one plane of the substrate where the ink receiving layer is not formed.

The recording medium may further include a protection layer formed on the ink fixation layer.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
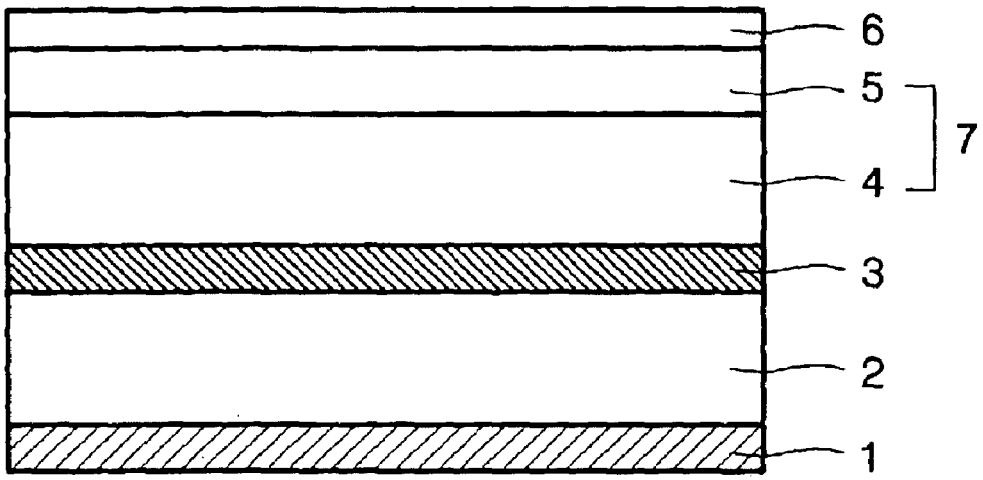
FIG. 1 is a cross-sectional view of a recording medium for an inkjet printer according to an embodiment the present invention.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures. The invention will now be described in more detail.

FIG. 1 is a cross-sectional view of a recording medium for an inkjet printer according to the present invention. The recording medium is formed by coating ink receiving layers 7 (4 and 5) on a substrate layer 2. As shown in FIG. 1, the ink receiving layer 7 may be formed of a multiple layer having an ink absorbing layer 4 and an ink fixation layer 5. Optionally, an undercoating layer 3 may be coated between the ink absorbing layer 4 and the substrate layer 2 or a back coating layer 1 may be formed under the substrate layer 2. Also, as a protection layer, an ink permeating layer 6 may be further formed on the ink fixation layer 5.

In the present invention, a desired effect can be obtained by forming the ink absorbing layer 4 having a microporous pigment as one of main components on a film without an absorbing property in itself, and forming the ink fixation layer 5 having a porous pigment and an appropriate amount of polyether siloxane copolymer. In a case of coating composition for the ink fixation layer 5, the ink absorbing layer 4 coated directly on the substrate 2 serves as a substrate.

Wetting refers to a phenomenon in which a coating composition in a liquid form spreads on a surface to be coated and is essential in obtaining desired properties of the coating. The inkjet coating having the microporous pigment as a main component is not a good substrate in itself. That is, in a case of forming another coating thereon, insufficient wetting, poor flowability or cratering may occur. Such problems may be overcome by adding a small amount of a surface activating material. In the present invention, the polyether siloxane copolymer is added.

The polyether siloxane copolymer reduces surface tension to offer substrate wetting, flowability, leveling or a cratering preventing effect. Also, the polyether siloxane copolymer is aligned at a coating/air interface, thereby providing slipping, anti-scratching, anti-blocking and releasing properties. Further, the polyether siloxane copolymer is slightly incompatible with polymer or oligomer, thereby effectuating anti-foaming and defoaming properties.

The polyether siloxane copolymer has a weight-average molecular weight in a range of 100 to 10,000, and has a Si—O—C bond or a Si—C bond between a polyether (A; ethylene/propylene oxide derivative) portion and a polysiloxane (B; $—Si(Me)_2O—$ or analog) portion. Also, the polyether siloxane copolymer has a copolymeric structure such as an ABA triblock copolymer, a branched copolymer, a comb-shaped copolymer or an $A(BA)_n$ block copolymer. The polyether siloxane copolymer is generally prepared by substituting some methyl groups in polydimethylsiloxane, called silicon oil and having a low molecular weight, with polyether, or by polymerizing monomers thereof.

Examples of the polyether siloxane copolymer commercially available in the market include SILWET DA series, such as SILWET 408, 560 or 806, SILWET L series such as SILWET-7602 or COATSIL series such as COATSIL 1211, manufactured by CK WITCO; KF351A, KF353A, KF354A, KF618, KF945A, KF352A, KF615A, KF6008, KF6001, KF6013, KF6015, KF6016, KF6017, manufactured by SHIN-ETSU; BYK-019, BYK-300, BYK-301, BYK-302, BYK-306, BYK-307, BYK-310, BYK-315, BYK-320, BYK-325, BYK-330, BYK-333, BYK-331, BYK-335, BYK-341, BYK-344, BYK-345, BYK-346, BYK-348, manufactured by BYK-CHEMIE; and GLIDE series such as GLIDE 450, FLOW series such as FLOW 425, WET series such as WET 265, manufactured by TEGO.

The polyether siloxane copolymer is used in an amount of 0.01 to 3 parts by weight per 100 parts by weight of solid matter in the ink fixation layer 5. If the amount of the polyether siloxane copolymer is less than 0.01 parts by weight per 100 parts by weight of the solid matter in the ink fixation layer 5, the adding effect is trivial. If the amount of the polyether siloxane copolymer is greater than 3 parts by weight, the inkjet printing suitability is adversely affected.

The ink absorbing layer 4 or the ink fixation layer 5 may include a pigment (inorganic filler), a binder and other additives. The pigment improves ink absorption of the ink receiving layer 7 and compensates for a fixing property of the dye, and examples thereof include inorganic fillers, such as silica, alumina, calcium carbonate, magnesium carbonate carbonate salt, barium sulfate, calcium sulfate or titanium dioxide, and mixtures thereof. The pigment may be in a form of powder of the inorganic filler materials. In some cases, the pigment may be in a sol state in which microporous particle components of the inorganic fillers are contained. In the latter case, since spherical particles in the sol state lack an ink absorbing property, it is possible that particles in the sol state are microporous. In particular, in a case of glossy photopaper, pigment particles used as an outermost coating of the ink receiving layer 7 preferably have a particle size of 20 to 200 nm. If the particles in the sol state have a particle size of less than 20 nm, the ink absorption is lowered. If the particles in the sol state have the particle size of greater than 200 nm, gloss of the recording medium is undesirably decreased.

The amount of the pigment in the ink absorbing layer 4 is from 50 to 95 parts by weight per 100 parts by weight of solid matter in the ink absorbing layer, that is, a mixture of the pigment, the binder and the polyethylsiloxane copolymer, preferably 60 to 90 parts by weight. The amount of the pigment in the ink fixation layer 5 is from 49 to 95 parts by weight per 100 parts by weight of solid matter in the ink fixation layer 5, that is, a mixture of the pigment, the binder and the polyethersiloxane copolymer, preferably 60 to 90 parts by weight. If the amount of the pigment is out of the range specified above, the ink absorption is undesirably lowered.

Examples of the binder used in the ink absorbing layer 4 or the ink fixation layer 5 include at least one selected from a group consisting of polyvinylalcohol, polyvinylpyrrolidone, methyl cellulose, hydroxypropylmethyl cellulose, gelatin, polyethylene oxide, acryl-based polymer, polyester, polyurethane and quaternary ammonium type copolymer. Examples of the quaternary ammonium copolymer include vinylpyrrolidone N,N-dimethylaminoethylmethacrylic acid copolymer lactate. The amount of the binder in the ink absorbing layer is from 5 to 50 parts by weight per 100 parts by weight of solid matter in the ink absorbing layer 4. The amount of the binder in the ink fixation layer 5 is from 5 to 50 parts by weight per 100 parts by weight of solid matter in the ink fixation layer 5. If the amount of the binder is less than the above range, the binder cannot function properly as a binder, resulting in poor adhesion of the ink absorbing layer containing the pigment. If the amount of the binder is greater than the above range, the amount of the pigment contained in the ink absorbing layer 4 is relatively reduced, lowering ink absorption and quick ink drying property.

A solvent for a composition for forming the ink receiving layer 7 according to the present invention, for example, the ink absorbing layer 4 or the ink fixation layer 5, is not particularly limited, and examples thereof include water, ketones, glycol ethers, alcoholic solvents, methylcellosolve and ethycellosolve in consideration of environments and workability. Examples of the ketones include acetone and methylethyl ketone. Examples of the glycol ethers include diethylene glycol, and diethylene glycol monobutyl ether, and examples of the alcoholic solvent include methanol, ethanol, butanol and isopropanol.

An amount of the solvent is adjusted such that a concentration of the solid matter in the composition for forming the ink absorbing layer 4 or the ink fixation layer 5 is from 5 to 40% by weight. If the concentration of the composition is less than 5% by weight, viscosity is too low, and drying is difficult to perform during coating. If the concentration of the composition is greater than 40% by weight, the viscosity is so high that a coating surface property becomes poor. The alcoholic solvent is used in an amount of 5 to 50% based on a total weight of the solvent used in the present invention. If the amount of the alcoholic solvent used is too small, a drying time is prolonged, and if the amount of the alcoholic solvent used is too much, the composition is disadvantageous in view of solubility and the cost increases.

To improve physical properties of the composition for forming the ink receiving layer 7, for example, the ink absorbing layer 4 or the ink fixation layer 5, various additives may be further added thereto. As one of the representative additives, a cross-linking agent serves to increase water resistance and surface intensity by performing a crosslinkage between the binder and the pigment when it is coated on the substrate 2. Thus, the cross-linking agent of the ink absorbing layer 4 is used in an amount of 0.2 to 8 parts by weight per 100 parts by total weight of the pigment and the binder in the ink absorbing layer 4, and the cross-linking agent of the ink fixation layer 5 is used in an amount of 0.2 to 8 parts by weight per 100 parts by a total weight of the pigment and the binder in the ink fixation layer 5. If the amount of the cross-linking agent is out of the range specified above, a crosslinking effect is not effectuated. Also, an excessive crosslinkage may impair the ink absorption. Examples of the cross-linking agent include oxazoline, isocyanate, epoxide, aziridine, mellamin-formaldehyde, dialdehyde, a boron compound and mixtures thereof. Examples of the isocyanate include tolylene diisocyanate (TDI) adducts, and examples of the epoxide include epichlorohydrin. Examples of the dialdehyde include glyoxal and glutaric dialdehyde, and examples of the boron compound include boric acid and borax.

Also, various additional additives including a fixing agent, a dye, a fluorescent dye, a light dispersing agent, a pH adjusting agent, an antioxidant, an antifoaming or defoaming agent, a lubricating agent and an anticurling agent, can be added. The fluorescent dye may increase apparent whiteness.

In the present invention, the additional additive is used in an amount of 0.015 to 10 parts by weight per a total amount, that is, per 100 parts by weight, of the pigment and the binder in the ink absorbing layer 4. The additional additive is used in an amount of 0.015 to 10 parts by weight per the total amount, that is, per 100 parts by weight, of the pigment and the binder in the ink fixation layer. If the amount of the additional additive is less than 0.015 parts by weight, the adding effect is negligible, and if the amount of the additional additive is greater than 10 parts by weight, the ink adaptability and the coating property of the recording medium may deteriorate.

A method of fabricating the recording medium using the composition for forming the ink receiving layer 7 will now be described. The composition for forming the ink absorbing layer 4 is coated on the substrate 4 and dried, thereby forming the ink absorbing layer 4. Then, the composition for the ink fixation layer 5 is coated on the ink absorbing layer 4 and dried, thereby completing the ink receiving layer 7.

The drying of the ink receiving layer 7 is performed at 50 to 130° C., and thermal crosslinking occurs by a cross-linking agent at this stage. If a drying temperature is lower than 50° C., crosslinkability is reduced, and if the drying temperature is higher than 130° C., yellowing may undesirably occur. In consideration of the ink absorption and fixing properties, an overall thickness of the thus-formed ink receiving layer 7 is in a range of 8 to 80 $\mu$m. If the thickness of the coated ink receiving layer is less than 8 $\mu$m, ink absorption decreases. If the thickness of the coated ink receiving layer 7 is greater than 80 $\mu$m, the cost may increase and the drying of the coated ink receiving layer 7 is difficult to achieve.

In the recording medium according to the present invention, synthetic paper, photographic paper, a polyester film such as polyethylene terephthalate, a polycarbonate film or a cellulose acetate film can be used as the substrate 2. To provide manageability and to prevent the substrate from warping when a coating is formed thereon, the thickness of the substrate 2 is preferably in a range of 70 to 350 g/m$^2$.

The recording medium according to the present invention has a layered structure shown in FIG. 1. Referring to FIG. 1, the ink receiving layer 7 is formed on the substrate 2.

As shown in FIG. 1, the recording medium may include the undercoating layer 3 between the substrate 2 and the ink receiving layer 7 having the ink absorbing layer 4 and the ink fixation layer 5, to enhance adhesion therebetween. The undercoating layer 3 is formed of a material selected from a group consisting of two-component primers such as polyol and polyisocyanate, and one-component primers such as acryls, urethanes, acryl-urethanes or vinyls. An amount of the undercoating layer 3 is in a range of 0.2 to 2 g/m$^2$, and a thickness thereof is in a range of 0.2 to 2.0 $\mu$m, preferably approximately 1 $\mu$m. Optionally, as the protection layer, the ink permeating layer 6 protecting the ink receiving layer 7 (4, 5) may be formed on the ink receiving layer 7 (4, 5) and the back coating layer 1 may be formed under the substrate 2.

The protection layer is formed of a compound which has good ink permeation and is curable to an extent to give good surface intensity, and is selected from a group consisting of cellulose-based compounds, polyethylene oxide-based compounds and cross-linking agent. A thickness of the protection layer coated is preferably in a range of 0.5 to 3 $\mu$m. In order to compensate for continuous feeding and curling properties, the back coating layer 1 is formed of a material selected from binder materials used in the ink absorbing layer 4, such as polyvinylalcohol, polyvinylpyrrolidone, methyl cellulose, hydroxypropylmethyl cellulose, gelatin, polyethylene oxide, acryl-based polymer, polyester, polyurethanes, and cross-linking agent materials such as oxazoline, isocyanate, epoxide, aziridine, mellamin-formaldehyde, dialdehyde and a boron compound. The thickness of the protection layer is preferably in the range of 0.5 to 4 $\mu$m.

The recording medium according to an aspect of the present invention is highly glossy photopaper that is used in inkjet printers, but of course other recording media may be used.

The present invention will be explained in detail hereinbelow with reference to examples. However, it should be understood that the invention is by no means limited to such specific examples.

In the examples and comparative examples, all "parts" and "%" indicate "parts by eight" and "parts by weight", respectively.

EXAMPLE 1

Onto resin-coated paper treated with gelatin of a basis weight of 200 g/m$^2$ was coated a coating solution having the following compositions for the ink absorbing layer 4 and the ink fixation layer 5 using a via coater, followed by drying at an oven at 110° C. for 3 minutes, giving approximately 25 g/m$^2$ of the ink absorbing layer 4 and approximately 10 g/m$^2$ of the ink fixation layer 5.

| | |
|---|---|
| 1) Ink absorbing layer | |
| Polyvinyl alcohol (F-17A, manufactured by ORIENTAL Chemical) | 30 parts |
| Silica (ML-381, manufactured by ORIENTAL Chemical) | 50 parts |
| Silica (CAB-O-SIL M-5, manufactured by CABOT) | 19 parts |
| Fluorescent dye (UVITEX NFW, manufactured by CIBA) | 1 part |
| 2) Ink fixation layer | |
| Polyvinyl alcohol (F-17A, manufactured by ORIENTAL Chemical) | 10 parts |
| Alumina sol (E-30, manufactured by HANA Chemical) | 81 parts |

-continued

| | |
|---|---|
| Fixing agent (GAFQUAT 755N, manufactured by ISP) | 3 parts |
| Glyoxal (manufactured by JUNSEI Chemical Co., Ltd.) | 3 parts |
| Boric acid (manufactured by ALDRICH) | 2 parts |
| Polyether siloxane additive (WET 265, manufactured by TEGO) | 1 part |

EXAMPLE 2

The ink receiving layer was prepared in the same manner as in Example 1 except that the following compositions were used:

| | |
|---|---|
| 1) Ink absorbing layer | |
| Polyvinyl alcohol (F-17A, manufactured by ORIENTAL Chemical) | 20 parts |
| Alumina sol (E-30, manufactured by HANA Chemical) | 80 parts |
| 2) Ink fixation layer | |
| Polyvinyl alcohol (F-17A, manufactured by ORIENTAL Chemical) | 10 parts |
| Alumina sol (E-30, manufactured by HANA Chemical) | 81 parts |
| Fixing agent (GAFQUAT 755N, manufactured by ISP) | 3 parts |
| Boric acid (manufactured by ALDRICH) | 2 parts |
| Polyether siloxane additive (FLOW 425, manufactured by TEGO) | 1 part |

COMPARATIVE EXAMPLE 1

The ink receiving layer was prepared in the same manner as in Example 1 except that the following compositions were used:

| | |
|---|---|
| 1) Ink absorbing layer | |
| Polyvinyl alcohol (F-17A, manufactured by ORIENTAL Chemical) | 30 parts |
| Silica (ML-381, manufactured by ORIENTAL Chemical) | 50 parts |
| Silica (CAB-O-SIL M-5, manufactured by CABOT) | 19 parts |
| Fluorescent dye (UVITEX NFW, manufactured by CIBA) | 1 part |
| 2) Ink fixation layer | |
| Polyvinyl alcohol (F-17A, manufactured by ORIENTAL Chemical) | 10 parts |
| Alumina sol (E-30, manufactured by HANA Chemical) | 82 parts |
| Fixing agent (GAFQUAT 755N, manufactured by ISP) | 3 parts |
| Glyoxal (manufactured by JUNSEI Chemical Co., Ltd.) | 3 parts |
| Boric acid (manufactured by ALDRICH) | 2 parts |

COMPARATIVE EXAMPLE 2

The ink receiving layer was prepared in the same manner as in Example 1 except that the following compositions were used:

| | |
|---|---|
| 1) Ink absorbing layer | |
| Polyvinyl alcohol (F-17A, manufactured by ORIENTAL Chemical) | 19 parts |
| Alumina sol (E-30, manufactured by HANA Chemical) | 80 parts |

-continued

| | |
|---|---|
| Polyether siloxane additive (FLOW425, manufactured by TEGO) | 1 part |
| 2) Ink fixation layer | |
| Polyvinyl alcohol (F-17A, manufactured by ORIENTAL Chemical | 10 parts |
| Alumina sol (E-30, manufactured by HANA Chemical) | 81 parts |
| Fixing agent (GAFQUAT 755N, manufactured by ISP) | 3 parts |
| Glyoxal (manufactured by JUNSEI Chemical Co., Ltd.) | 3 parts |

-continued

| | |
|---|---|
| Boric acid (manufactured by ALDRICH) | 2 parts |
| Polyether siloxane additive (FLOW 425, manufactured by TEGO) | 1 part |

COMPARATIVE EXAMPLE 3

The ink receiving layer was prepared in the same manner as in Example 1 except that the ink receiving layer was formed as a single layer using the following compositions (approximately 35 g/m$^2$):

| Ink receiving layer | |
|---|---|
| Polyvinyl alcohol (F-17A, manufactured by ORIENTAL Chemical) | 25 parts |
| Silica (ML-381, manufactured by DONGYANG Chemical) | 45 parts |
| Silica (CAB-O-SII M-5, manufactured by CABOT) | 20 parts |
| Fixing agent (HF-59, manufactured by HANSOL Chemical) | 3 parts |
| Glyoxal (manufactured by JUNSEI Chemical Co., Ltd.) | 3 parts |
| Boric acid (manufactured by ALDRICH) | 2 parts |
| Fluorescent dye (UVITEX NFW, manufactured by CIBA) | 1 part |
| Polyether siloxane additive (WET 265, manufactured by TEGO) | 1 part |

COMPARATIVE EXAMPLE 4

The ink receiving layer was prepared in the same manner as in Example 1 except that the ink receiving layer was formed as a single layer using the following compositions (approximately 35 g/m$^2$):

| Ink receiving layer | |
|---|---|
| Polyvinyl alcohol (F-17A, manufactured by ORIENTAL Chemical) | 10 parts |
| Alumina sol (E-30, manufactured by HANA Chemical) | 82 parts |
| Fixing agent (GAFQUAT 755N, manufactured by ISP) | 3 parts |
| Glyoxal (manufactured by JUNSEI Chemical Co., Ltd.) | 3 parts |
| Boric acid (manufactured by ALDRICH) | 2 parts |

Various properties of the recording media for the inkjet printer prepared in Examples 1 and 2, and Comparative Examples 1 to 4, including ink absorption, color vividness (bleeding), color (optical density), coating surface property (determination by eye), roughness and gloss, were evaluated, and the results thereof are listed in Tables 1 to 3.

Image printing was performed using an inkjet printer (MJC-1130i, manufactured by SAMSUNG Electronics Co., Ltd.) or a color inkjet printer (EPSON STYLUS PHOTO 1290, manufactured by EPSON).

TABLE 1

| | Example 1 | Example 2 | Comparative Example 1 | Comparative Example 2 | Comparative Example 3 | Comparative Example 4 |
|---|---|---|---|---|---|---|
| Ink absorption | ○ | ○ | ○ | ○ | ○ | Δ |
| Vividness (Bleeding) | ○ | ○ | ○ | ○ | Δ | Δ |

*Ink absorption: Immediately after printing a composite black color, standard image (EPSON STYLUS PHOTO 1290) on an A4 size recording medium sample, vellum paper was overlapped and 5 kg of a mass of iron was then placed thereon for 10 seconds, evaluating conditions of the vellum paper smeared with ink.

*Color vividness (bleeding): 24 hours after printing the composite black color, standard image (EPSON STYLUS PHOTO 1290) on an A4 size recording medium sample, the vividness of standard lines of the sample was evaluated.

TABLE 2

| | Optical Density | | | |
|---|---|---|---|---|
| | Yellow (Y) | Magenta (M) | Cyan (C) | Black (Y + C + M) |
| Example 1 | 0.73 | 0.91 | 0.72 | 1.76 |
| Example 2 | 0.72 | 0.90 | 0.73 | 1.75 |
| Comparative Example 1 | 0.71 | 0.90 | 0.72 | 1.74 |
| Comparative Example 2 | 0.73 | 0.92 | 0.72 | 1.76 |
| Comparative Example 3 | 0.68 | 0.84 | 0.65 | 1.59 |
| Comparative Example 4 | 0.71 | 0.90 | 0.71 | 1.68 |

Optical density: The respective colors of ink were printed on 2 cm×2 cm size samples using MJC-1130i and optical density was evaluated.

TABLE 3

| | Example 1 | Example 2 | Comparative Example 1 | Comparative Example 2 | Comparative Example 3 | Comparative Example 4 |
|---|---|---|---|---|---|---|
| Coating surface property | ○ | ○ | X | X | ○ | ○ |
| Roughness (μm) | 0.17 | 0.14 | 2.1 | 2.7 | 1.6 | 0.18 |
| Gloss | 90 | 92 | 88 | 84 | 41 | 82 |

Coating surface property (determination by eye): Coating defects, such as bubbling of greater than 1 μm in diameter, pinholes or cratering, occurring in 10 cm×10 cm size sample, were examined (O: not greater than 3 defects, Δ: 4 to 10 defects, X: not fewer than 11 defects).

Roughness: Roughness was measured at arbitrary 10 spots of an A4 size sample using a roughness tester (TR-100, manufactured by TIMES) and the average of the measured roughness values was obtained. The higher the average value, the more severe the surface roughness.

Gloss: Gloss was measured using a gloss tester (T480A, manufactured by TECHNIDYNE) at 75° C.

After printing standard images or lines using a color inkjet printer (EPSON STYLUS PHOTO 1290, manufactured by EPSON), tests of ink absorption and vividness were carried on the recording media for the inkjet printer prepared in Examples 1 and 2 and Comparative examples 1 to 4. After printing yellow, magenta, cyan and composite black pigments on 2 cm×2 cm size samples using a color inkjet printer (MJC-1310i, manufactured by SAMSUNG Electronics), the optical density of each sample was measured. Also, defects in coating surface property were observed by eye, and the roughness and gloss were measured by a roughness tester (TR-100 manufactured by TIME) and a gloss tester (T480A, manufactured by TECHNIDYNE), respectively.

As shown in Tables 1 and 3, the recording media prepared in Examples 1 and 2 are good in ink absorption, vividness, coating surface property, roughness and gloss. Also, the recording media prepared in Comparative Examples 1 and 2 are good in the ink absorption and the vividness. However, the recording media prepared in Comparative Examples 1 and 2 are poor in a coating surface property due to surface defects of coatings, resulting in considerable deterioration of the roughness compared to those prepared in Examples 1 and 2.

In Comparative Example 2, the polyether siloxane copolymer was added to the ink fixation layer and the additive was added to the lower ink absorbing layer. Thus, the adding effect was difficult to achieve at the upper ink fixation layer.

In Comparative Example 3, since the ink receiving layer was formed of a single layer with silica, having a larger particle size than alumina used for the ink fixation layer, it had good ink absorption but had very poor gloss. Also, the vividness and the roughness of the ink receiving layer of Comparative Example 3 were slightly poor compared to the cases in Examples 1 and 2.

In Comparative Example 4 in which the ink receiving layer is a single-component layer made of the alumina only, without the ink absorbing layer with particles having good ink absorption, the ink absorption thereof is slightly reduced. As shown in Table 2, the optical density of each among yellow, magenta and cyan is not reduced, compared to the cases in the Examples. In contrast, in a case of the composite black color, since three color inks are printed at once, a drying time is prolonged, adversely affecting the optical density and vividness (bleeding) of the ink receiving layer.

Table 2 shows the optical density of each of yellow, magenta, cyan and composite pigments. Although the recording media prepared in Comparative Examples 1 and 2 are rather poor in external quality such as coating surface property or roughness, the ink absorption and fixation properties thereof are not so bad, that is, the recording media corresponding to the respective colors have high levels of the ink absorption and fixation properties. This is because the ink receiving layers of Comparative Examples 1 and 2 have a multi-layered structure comprising an ink absorbing layer and an ink fixation layer, like in the cases of Examples 1 and 2.

In Comparative Example 3 in which the ink receiving layer was formed of a single layer with silica having a large particle size, the ink absorption of the ink receiving layer is not bad compared to that of the ink receiving layer of Example 1 or 2. However, since ink pigments permeate down to the ink receiving layer, the optical density is slightly reduced.

In Comparative Example 4, as described above, a reduction in optical density occurs only at the composite black due to reduced ink absorption.

As described above, in the recording media for the inkjet printer according to the present invention having multiple coatings of two or more ink receiving layers having at least a pigment and a binder resin on a substrate, good coating surface properties are provided by improving substrate wetting, a leveling property and flowability by adding the polyether siloxane copolymer to an upper ink receiving layer, as a component for enhancing physical properties of the upper ink receiving layer.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A recording medium for an inkjet printer, including a substrate and an ink receiving layer formed thereon, wherein the ink receiving layer comprises:

an ink absorbing layer, between the substrate and an ink fixation layer, having a first pigment and a first binder; and the ink fixation layer, formed on the ink absorbing layer, having a second pigment, a second binder and a polyether siloxane copolymer.

2. The recording medium of claim 1, wherein a weight-average molecular weight of the polyether siloxane copolymer is in a range of 100 to 10,000.

3. The recording medium of claim 1, wherein an amount of the polyether siloxane copolymer is in a range of 0.01 to 3 parts by weight per 100 parts by weight of solid matter in the ink fixation layer.

4. The recording medium of claim 1, wherein the polyether siloxane copolymer is at least one selected from a group consisting of dimethylsiloxane-methyl (polyoxyethylene) copolymer, dimethylsiloxane-methyl (polyoxyethylene-polyoxypropylene) siloxane copolymer, trisiloxane alkoxylate as a copolymer of trisiloxane and polyether, and siloxane propoxylate as a copolymer of siloxane and polypropylene oxide.

5. The recording medium of claim 1, wherein one of the first and second pigments is at least one selected from the group consisting of silica, alumina, calcium carbonate, magnesium carbonate, barium sulfate, calcium sulfate and titanium dioxide.

6. The recording medium of claim 5, wherein the one of the first and second pigments is in a form of powder or sol.

7. The recording medium of claim 5, wherein the amount of the first pigment in the ink absorbing layer is from 50 to 95 parts by weight per 100 parts by weight of solid matter in the ink absorbing layer, and the amount of the second pigment in the ink fixation layer is from 50 to 95 parts or from 49 to 95 parts by weight per 100 parts by weight of solid matter in the ink fixation layer.

8. The recording medium of claim 1, wherein one of the first and second binders is at least one selected from a group consisting of polyvinylalcohol, polyvinylpyrrolidone, methyl cellulose, hydroxypropylmethyl cellulose, gelatin, polyethylene oxide, acryl-based polymer, polyester, polyester and quaternary ammonium type copolymer.

9. The recording medium of claim 8, wherein an amount of the first binder in the ink absorbing layer is from 5 to 50 parts by weight per 100 parts by weight of solid matter in the ink absorbing layer, and the amount of the second binder in the ink fixation layer is from 5 to 50 parts by weight per 100 parts by weight of solid matter in the ink fixation layer.

10. The recording medium of claim 1, wherein one of the ink absorbing layer and the the ink fixation layer further comprises an additive, and the additive is at least one selected from a group consisting of a cross-linking agent, a fixing agent, a dye, a fluorescent dye, a light dispersing agent, a pH adjusting agent, an antioxidant, an antifoaming or defoaming agent, a lubricating agent and an anticurling agent.

11. The recording medium of claim 10, wherein an amount of the additive in the ink absorbing layer is from 0.015 to 10 parts by weight per 100 parts by a total weight of the pigment and the binder in the ink absorbing layer, and the amount of the additive in the ink fixation layer is from 0.015 to 10 parts by weight per 100 parts by the total weight of the pigment and the binder in the ink fixation layer.

12. The recording medium of claim 10, wherein the cross-linking agent is at least one selected from a group consisting of oxazoline, isocyanate, epoxide, aziridine, mellamin-formaldehyde, dialdehyde and a boron compound.

13. The recording medium of claim 1, wherein the substrate comprises: synthetic paper, photographic paper, a polyester film, a polycarbonate film or a cellulose acetate film.

14. The recording medium of claim 1, further comprising:

an undercoating layer formed between the substrate and the ink receiving layer.

15. The recording medium of claim 1, further comprising a back coating layer formed on one plane of the substrate where the ink receiving layer is not formed.

16. The recording medium of claims 1, further comprising:

a protection layer formed on the ink fixation layer.

17. A recording medium for an inkjet printer, comprising:

a substrate having an undercoating layer;

an ink absorbing layer formed on the undercoating layer of the substrate and having a first pigment and a first binder; and an ink fixation layer formed on the ink absorbing layer and having a second pigment, a second binder, and a material having an antifoaming property, wherein the material comprises: polyether siloxane copolymer.

18. The recording medium of claim 17, wherein the first and second pigments are made of the same material.

19. The recording medium of claim 17, wherein the first and second pigments are in the same amount.

20. The recording medium of claim 17, wherein the first pigment has a first amount of a first total amount of solid matter of the ink absorbing layer, the second pigment has a second amount of a second total amount of solid matter of the ink fixation layer, and the first amount is different from the second amount.

21. The recording medium of claim 17, wherein the first and second binders are made of the same material.

22. The recording medium of claim 17, wherein the first and second binders are in the same amount.

23. The recording medium of claim 17, wherein the first binder has a first amount of a first total amount of solid matter of the ink absorbing layer, the second binder has a second amount of a second total amount of solid matter of the ink fixation layer, and the first amount is different from the second amount.

* * * * *

UNITED STATES PATENT AND TRADEMARK OFFICE

CERTIFICATE OF CORRECTION

PATENT NO. : 6,913,801 B2
DATED : July 5, 2005
INVENTOR(S) : Jae-hwan Kim et al.

It is certified that error appears in the above-identified patent and that said Letters Patent is hereby corrected as shown below:

Column 13,
Lines 22-23, after "from" delete "50 to 95 parts or from".
Line 38, change "the ink fixation" to -- ink fixation --.

Signed and Sealed this

Fourteenth Day of March, 2006

JON W. DUDAS
*Director of the United States Patent and Trademark Office*